US006238542B1

(12) United States Patent
Helden

(10) Patent No.: US 6,238,542 B1
(45) Date of Patent: May 29, 2001

(54) WATER SOLUBLE BRIGHTENERS FOR ZINC AND ZINC ALLOY ELECTROLYTES

(76) Inventor: Thomas Helden, Pfeilstrass 3, D-42655, Solingen (DE)

( * ) Notice: Subject to any disclaimer, the term of this patent is extended or adjusted under 35 U.S.C. 154(b) by 0 days.

(21) Appl. No.: 09/394,839

(22) Filed: Sep. 13, 1999

(30) Foreign Application Priority Data

| | | |
|---|---|---|
| Sep. 15, 1998 | (DE) | 198 42 098 |
| Sep. 2, 1999 | (DE) | 199 41 765 |
| Sep. 2, 1999 | (EP) | 99117272 |

(51) Int. Cl.[7] ..... C25D 3/22
(52) U.S. Cl. ..... 205/312; 205/244
(58) Field of Search ..... 205/244, 312

(56) References Cited

U.S. PATENT DOCUMENTS

| | | | | |
|---|---|---|---|---|
| 3,769,184 | | 10/1973 | Rushmere . | |
| 3,822,194 | | 7/1974 | Rushmere . | |
| 3,823,076 | | 7/1974 | Rushmere . | |
| 4,170,526 | * | 10/1979 | Creutz et al. | 204/55 R |
| 4,397,717 | * | 8/1983 | Acimovic et al. | 204/55 Y |
| 4,444,630 | * | 4/1984 | Steinecker | 204/55 R |

FOREIGN PATENT DOCUMENTS

| | | | |
|---|---|---|---|
| 0037634A1 | | 10/1981 | (EP) . |
| 0649918A1 | | 4/1995 | (EP) . |
| 2012306A | | 7/1979 | (GB) . |
| 10245693 | * | 9/1998 | (JP) . |

OTHER PUBLICATIONS

Miglinaite et al., Effect of certain brighteners on zinc electroplating and the structure of electroplates in cyanide solutions, 1984, Conference, Abstract.*
Deres et al., Effect of some brightening agents on the kinetics of zinc electroplating from a cyanide electrolyte, 1976, Conference, Abstract.*
Lowenheim, Electroplating, 1978, pp. 175–182.*

* cited by examiner

*Primary Examiner*—Kathryn Gorgos
*Assistant Examiner*—Christopher M. Keehan
(74) *Attorney, Agent, or Firm*—Warn, Burgess & Hoffmann, P.C.

(57) ABSTRACT

A process for the galvanic precipitation of zinc deposits and/or zinc alloy deposits on a metallic surface, working with an aqueous acid electrolyte which contains at least one zinc salt as well as at least one high-gloss agent. At least one heterocyclic aromatic compound is added to the electrolyte, with at least one alkylated nitrogen atom as the heteroatom.

25 Claims, No Drawings

WATER SOLUBLE BRIGHTENERS FOR ZINC AND ZINC ALLOY ELECTROLYTES

BACKGROUND

FIELD OF THE INVENTION

The invention concerns a process for the galvanic precipitation of zinc deposits and/or zinc-alloy deposits on a metallic surface, working with an aqueous acid electrolyte which contains at least one zinc salt and at least one high-gloss agent.

Different processes for the galvanic precipitation of zinc deposits and zinc alloy deposits are known from in practice. To this extent, comparable acid zinc electrolytes or zinc-alloy electrolytes are also known. Coating of metallic surfaces is usually carried out on the basis on the good anti-corrosion effect achieved by the zinc or zinc-alloy layers. It is often also desirable for the zinc or zinc-alloy coats to have a glossy surface and fulfil ornamental purposes. High-gloss agents are added to the electrolytes for this purpose, which, interacting as needed with other electrolytic components, produce the gloss on the zinc or zinc-alloy coats. In the processes mentioned above known in practice, aromatic carbonyl compounds, particularly benzylacetone or benzophenone as well as o-chlorobenzaldehyde, are used. The high-gloss agents are usually employed in a solution of alcohol, particularly methanol. Special safety precautions are necessary in the manufacture, transportation and storage of these solutions, because of their high flammability and toxicity. The disadvantage is unnecessary expense. The high-gloss agents are also used in higher boiling solvents, in butyl glycol for example, which bring disadvantages of a physiological nature. Since the solubility of the familiar high-gloss agents mentioned is very low, they must be solubilized with high concentrations of wetting agents in the aqueous electrolytes. This is also complicated and costly.

SUMMARY OF THE INVENTION

By contrast, the invention starts with the technical problem of describing a process as described above which works with water-soluble high-gloss agents which produce optimal gloss on the zinc and zinc-alloy coats in a simple and safe way.

DETAILED DESCRIPTION OF THE INVENTION

To solve this technical problem, the invention defines a process as described above whose characteristic is that a heterocyclic aromatic compound, with at least one alkylated nitrogen atom as the heteroatom, is added to the electrolyte as the high-gloss agent. Heterocyclic aromatic compounds are also called heteroaromatics. According to the invention, the heterocyclic aromatic compounds used have at least one nitrogen atom as the heteroatom, to which an alkyl group is bonded. To this extent, they are n-alkylated heterocyclic aromatic compounds. The heterocyclic aromatic compound used as the high-gloss agent can also have several alkylated nitrogen atoms as heteroatoms. It is within the scope of the invention that the alkyl groups bonded to the nitrogen atom are straight-chain, branched or cyclic. The alkyl groups can also contain double bonds and/or triple bonds. In one version of the invention, hydrogen atoms in the alkyl groups are replaced by functional groups. So the hydrogen atoms in the alkyl groups can be replaced by hydroxyl groups and or ether groups and/or carboxyl groups and/or ester groups and/or halogen atoms and/or sulfonate groups and/or aromatic rings and/or amino groups.

It is within the scope of the invention that the heterocyclic aromatic compound used as the high-gloss agent has additional heteroatoms besides one or several alkylated nitrogen atoms. They can be non-alkylated nitrogen atoms to which, depending on the bonding conditions, a hydrogen atom can also be bonded. But in this case, it can also be other heteroatoms, such as oxygen or sulfur atoms. In one version of the invention, the heterocyclic aromatic compound can have at least one additional nitrogen atom as the heteroatom; no alkyl group is bonded to this nitrogen atom. It is within the scope of the invention that other substitutes are bonded to the carbon atoms of the heterocyclic aromatic compound in place of hydrogen atoms. For example, alkyl groups and/or ether groups and/or carboxyl groups and/or halogen atoms and/or sulfonate groups and/or amino groups and/or hydroxyl groups can be bound to these carbon atoms. In one version of the invention, a condensed ring system is used as a heterocyclic aromatic compound, which contains aromatic and/or non-aromatic rings. In this version, one ring alone, or several rings, or all the rings can each have at least one heteroatom.

Preferably at least one N-alkylated 5-ring heteroaromatic and/or at least one N-alkylated 6-ring heteroaromatic is added to the electrolyte as the heterocyclic aromatic compound. These 5-ring heteroaromatics and/or 6-ring heteroaromatics are particularly suitable as high-gloss agents for zinc and/or zinc-alloy precipitation. In the preferred version, which has is a particularly important part of the invention, at least one N-alkylated pyridine is added as a heterocyclic aromatic compound. N-hexadecylpyridine chloride as the high-gloss agent is the preferred additive. Furthermore, the use of dodecylpyridine chloride and/or N-benzylpyridinium-3-carboxylate is preferred. In this context, it must be pointed out that it is part of the invention that the heterocyclic aromatic compound can be used in the form of quaternary salt as a high-gloss agent. Then the electrolyte has an assigned inorganic or organic anion, which is advantageously compatible with the other electrolyte components. As a matter of preference, they are halides, sulfations, hydrogen sulfations, tetrafluoride borates or acetates. In principal, the invention involves, for example, the use of N-alkylated pyrroles and/or N-alkylated pyrazolenes and/or N-alkylated imidazoles and/or N-alkylated quinolines as high-gloss agents.

In a preferred version of the invention, the heterocyclic aromatic compound is used in a concentration of 0.001 g/l to 100 g/l, preferably 0.005 g/l to 10 g/l, referenced to the electrolyte. It is within the scope of the invention that other known high-gloss agents are used in addition to the heterocyclic aromatic compound. The total concentration of the high-gloss agent added to the electrolyte in this case is 0.001 g/l to 100 g/l, preferably 0.005 g/l to 10 g/l, referenced to the electrolyte.

Different types of electrolyte are known for the precipitation of zinc deposits and/or zinc-alloy deposits. The preferred method is to use a zinc electrolyte on a zinc chloride base to precipitate zinc deposits. The zinc electrolyte contains 5 g/l to 500 g/l of zinc salt, preferably zinc chloride. To precipitate zinc-cobalt alloys, the electrolyte contains a zinc salt, preferably 50 g/l to 150 g/l zinc salt, preferably zinc chloride, as well as a cobalt salt, preferably cobaltous chloride. A zinc salt in the amount of 5 g/l to 500 g/l, preferably 50 g/l to 150 g/l, and cobaltous salt in the amount of 0.01 g/l to 150 g/l, preferably 1 g/l. to 50 g/l is used. To precipitate zinc-nickel alloys, a zinc salt, preferably zinc chloride, as well as a nickel salt, preferably nickel chloride, is added to the electrolyte. The concentration of zinc salt in the electrolyte is 5 g/l to 500 g/l, preferably 50 g/l to 150 g/l, and the concentration of nickel salt in the electrolyte is 0.01 g/l to 150 g/l, preferably 1 g/l to 50 g/l. The electrolyte is preferably adjusted to mildly acidic. For practical purposes, the electrolyte has a pH of 4 to 6. It is within the scope of the invention that the electrolyte contains conducting salt. The preferred conductive salt used is ammonium chloride and/or potassium chloride and/or sodium chloride. For practical purposes, the electrolyte has of 5 g/l to 250 g/l of conducting salt by volume.

In the preferred version of the invention, at least one sufactant is added to the electrolyte. The preferred choice is a sufactant concentration of 0.001 g/l to 100 g/l, preferably 0.5 g/l to 20 g/l, referenced in each case to the electrolyte. In one version of the invention, at least one non-ionic sufactant from the "alkyl alcoxyl, aryl alcoxyl, alkylaryl alcoxyl" group is added to the electrolyte. In another version of the invention, at least one anionic sufactant from the "sulfated and/or sulfonated alkyl alcoxyl, sulfated and / or sulfonated aryl alcoxyl, sulfated and/or sulfonated alkylaryl alcoxyl" group is added to the electrolyte. The minimum of one surfactant added to the electrolyte also functions as a so-called auxiliary gloss agent. As a matter of preference, the electrolyte also contains at least one polyglycol, which is preferably used in conjunction with at least one surfactant in the electrolyte.

It is part of the invention that at least one substance from the "aromatic carbon acids, hydroxy carbon acids, derivative from the previously named acids" group is added to the electrolyte. Derivative from the acid means here a salt from the acids. Preferably benzoin acid and/or nicotinic acid and/or salicylic acid, or at least a derivative from the previously named acids is added to the electrolyte. The above listed acids and/or their derivatives are advantageously contained in a concentration of 1 g/l to 50 g/l in the electrolyte. The substances mentioned improve precipitation in as broad a current density range as possible.

It is within the scope of the invention that polyhydric aromatic alcohols, to whose carbon atoms alkyl, ether, sulfonate or formyl groups can be bonded, as well as aliphatic carbon acids, which can carry hydroxy-, mercapto-, amino- or halide groups, as well as the alcoxylates of these compounds, can be used in place of hydrogen to improve the precipitation.

The invention is based on the finding that, when the heterocyclic aromatic compounds are used as part of the invention, substances are involved which are eminently suitable as high-gloss agents for the galvanic precipitation of zinc deposits and/or zinc-alloy deposits. These compounds are furthermore completely water-soluble high-gloss agents, so that the disadvantages described above in conjunction with known measures can be avoided. The required high concentrations of wetting agents in the electrolyte for the known high-gloss agents are not necessary for the heterocyclic aromatic compounds of the invention. In this respect, the high-gloss agents according to the invention can be introduced into the electrolyte in a simple fashion and nonetheless effect functionally reliable precipitation of high-gloss zinc-alloy coats. In the result, the process according to the invention is differentiated by less complicated and less expensive steps. The invention is explained in greater detail below, using examples of different versions. Example 1 relates to a prior art process. Examples 2 through 4 relate to the process according to the invention.

EXAMPLE OF VERSION 1

An electrolyte having the following composition was placed in a Hull cell: 35 g/l $Zn^{2+}$ (as $ZnCl_2$), 235 g/l KCl, 25 g/l $H_3BO_3$, 4 g/l sodium benzoate, 6 g/l Lutensol ON 110 (BASF) and 2 g/l Lutensite AP 14 (BASF). At a pH value of 5.6, a steel sheet was coated at a temperature between 20 and 30° C. with circulating air and with an amperage of 2 A for 10 minutes. The deposit was bright, but with no gloss.

EXAMPLE OF VERSION 2

An additional 0.5 g/l 1-(3-sulfopropyl)-pyridine betaine was added to an electrolyte identical to example 2. The deposit precipitated under the same conditions as in example 1 demonstrated gloss in the area of high current density.

EXAMPLE OF VERSION 3

0.05 g/l dodecylpyridine chloride was added to an electrolyte identical to example 1. Compared with example 1, an expanded area of gloss was identified.

EXAMPLE OF VERSION 4

0.1 g/l of N-benzylpyridine-3-carboxylate was added to an electrolyte identical to example 1. After the coating, the entire plate demonstrates optimal gloss except in very small areas of very high and very low current density.

What is claimed is:

1. A process for galvanic precipitation of zinc deposits and/or zinc alloy deposits comprising:

(a) providing an aqueous acid electrolyte effective for galvanic precipitation of a zinc or zinc alloy deposit on a metallic surface, said electrolyte containing at least one bath soluble zinc salt and a high gloss enhancing agent effective for imparting a high gloss on the subsequent deposit, said high gloss agent selected from the group consisting of N-alkylated pyrazolenes, N-alkylated pyroles, N-alkylated imidazoles, N-alkylated quinolines and mixtures thereof, wherein the alkyl group attached to the nitrogen has three or greater carbon atoms, quarternary salts and mixtures thereof; and (b) depositing a high gloss zinc or zinc alloy coating on said metallic surface.

2. The process of claim 1 wherein said high gloss enhancing agent is at least one N-alkylated pyridine.

3. The process of claim 1 wherein the concentration of said high gloss enhancing agent is 0.001 g/l to 100 g/l.

4. The process of claim 1 wherein the concentration of said high gloss enhancing agent is from about 0.005 g/l to 10 g/l.

5. The process of claim 1 wherein said electrolyte further includes a surfactant.

6. The process of claim 5 wherein the concentration of said surfactant is from about 0.001 g/l to about 100 g/l.

7. The process of claim 5 wherein the concentration of said surfactant is from about 0.5 g/l to about 20 g/l.

8. The process of claim 5 wherein the surfactant is an ionic surfactant selected from the group consisting of an alkylalkoxylate, arylalkoxylate, alkyl aryl alkoxylate, and mixtures thereof.

9. The process of claim 5 wherein said surfactant is an anionic surfactant selected from the group consisting of sulfated and/or sulfonated alkylalkoxylate, sulfated and/or sulfonated arylalkoxylate, sulfated and/or sulfonated alkyl aryl alkoxylate.

10. The process of claim 1 further comprising a polyglycol additive.

11. A process for galvanic precipitation of zinc deposits and/or zinc alloy deposits comprising:

(a) providing an aqueous acid electrolyte effective for galvanic precipitation of a zinc or zinc alloy deposit on a metallic surface, said electrolyte containing at least one bath soluble zinc salt and a high gloss enhancing agent effective for imparting a high gloss on the subsequent deposit, the gloss enhancing agent selected from the group consisting of 1-(3-sulphopropyl)-pyridine betaine, N-hexadecylpyridine chloride, dodecylpyridine chloride, N-benzylpyridine-3-carboxylate, quarternary salts thereof, and mixtures thereof; and (b) depositing a high gloss zinc or zinc alloy coating on said metallic surface.

12. The process of claim 11 wherein the concentration of said high gloss enhancing agent is 0.001 g/l to 100 g/l.

13. The process of claim 11 wherein the concentration of said high gloss enhancing agent is from about 0.005 g/l to 10 g/l.

14. The process of claim 11 wherein said electrolyte further includes a surfactant.

15. The process of claim 14 wherein the concentration of said surfactant is from about 0.001 g/l to about 100 g/l.

16. The process of claim 14 wherein the concentration of said surfactant is from about 0.5 g/l to about 20 g/l.

17. The process of claim 14 wherein the surfactant is an ionic surfactant selected from the group consisting of an alkylalkoxylate, arylalkoxylate, alkyl aryl alkoxylate, and mixtures thereof.

18. The process of claim 14 wherein said surfactant is an anionic surfactant selected from the group consisting of sulfated and/or sulfonated alkylalkoxylate, sulfated and/or sulfonated arylalkoxylate, sulfated and/or sulfonated alkyl aryl alkoxylate.

19. The process of claim 11 further comprising a polyglycol additive.

20. A process for galvanic precipitation of zinc deposits and/or zinc alloy deposits comprising:

(a) providing an electrolyte including:

(a) an effective amount of zinc ions for galvanic precipitation of a zinc or zinc alloy deposit on a metallic surface;

(b) an ionic or anionic surfactant;

(c) a polyglycol additive; and (d) 0.001 g/l to about 100 g/l of a high gloss enhancing agent selected from the group consisting of 1-(3-sulphopropyl)-pyridine betaine, N-hexadecylpyridine chloride, dodecylpyridine chloride, N-benzylpyridium-3-carboxylate, quarternary salts thereof and mixtures thereof; and (b) depositing a high gloss zinc or zinc alloy coating on said metallic surface.

21. The process of claim 20 wherein the concentration of said high gloss enhancing agent is from about 0.005 g/l to 10 g/l.

22. The process of claim 20 wherein the concentration of said surfactant is from about 0.001 g/l to about 100 g/l.

23. The process of claim 20 wherein the concentration of said surfactant is from about 0.5 g/l to about 20 g/l.

24. The process of claim 20 wherein the surfactant is an ionic surfactant selected from the group consisting of an alkylalkoxylate, arylalkoxylate, alkyl aryl alkoxylate, and mixtures thereof.

25. The process of claim 20 wherein said surfactant is an anionic surfactant selected from the group consisting of sulfated and/or sulfonated alkylalkoxylate, sulfated and/or sulfonated arylalkoxylate, sulfated and/or sulfonated alkyl aryl alkoxylate.

* * * * *